US009139000B2

(12) United States Patent
Hirai

(10) Patent No.: US 9,139,000 B2
(45) Date of Patent: Sep. 22, 2015

(54) LIQUID EJECTING HEAD AND LIQUID EJECTING APPARATUS

(71) Applicant: SEIKO EPSON CORPORATION, Tokyo (JP)

(72) Inventor: Eiju Hirai, Minowa-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 17 days.

(21) Appl. No.: 14/207,152

(22) Filed: Mar. 12, 2014

(65) Prior Publication Data

US 2014/0263727 A1 Sep. 18, 2014

(30) Foreign Application Priority Data

Mar. 13, 2013 (JP) ..... 2013-051087

(51) Int. Cl.
*B05B 1/08* (2006.01)
*B41J 2/14* (2006.01)

(52) U.S. Cl.
CPC .... *B41J 2/14233* (2013.01); *B41J 2002/14241* (2013.01); *B41J 2002/14419* (2013.01); *B41J 2002/14491* (2013.01)

(58) Field of Classification Search
CPC ..... B05B 17/0638; B05B 17/0623; B05B 17/0615; B05B 17/06; B05B 17/063
USPC ..... 239/102.2, 102.1, 589.1, 337
See application file for complete search history.

(56) References Cited

U.S. PATENT DOCUMENTS 4,702,418 A * 10/1987 Carter et al. ..... 239/101
5,312,281 A * 5/1994 Takahashi et al. ..... 446/25
6,049,158 A * 4/2000 Takeuchi et al. ..... 310/328
8,406,084 B2 * 3/2013 Buccafusca et al. ..... 367/176
2009/0284568 A1 11/2009 Yazaki

FOREIGN PATENT DOCUMENTS

JP 2009-172878 A 8/2009

* cited by examiner

*Primary Examiner* — Davis Hwu
(74) *Attorney, Agent, or Firm* — Maschoff Brennan

(57) ABSTRACT

A liquid ejecting head includes a flow-path forming substrate including pressure generation chambers that communicate with nozzle openings through which ink is ejected, a piezoelectric element that applies a pressure to the pressure generation chambers via a diaphragm, and a protection substrate that forms a sealed space for sealing the piezoelectric element, in which a pressure in the sealed space is adjusted such that the diaphragm is drawn up to the piezoelectric element side and an initial bent position of the diaphragm is adjusted.

8 Claims, 11 Drawing Sheets

LIQUID EJECTING HEAD AND LIQUID EJECTING APPARATUS

BACKGROUND

1. Technical Field

The present invention relates to a liquid ejecting head and a liquid ejecting apparatus and, particularly, relates to an ink jet type recording head and an ink jet type recording apparatus which eject ink as liquid.

2. Related Art

Recently, a liquid ejecting head in which a pressure of liquid in a pressure generation chamber is changed by an actuator device, such as a piezoelectric element, and thus the liquid droplets is ejected through nozzles communicating with the pressure chamber has been known. An ink jet type recording head which ejects ink droplets as liquid droplets is a representative example of the liquid ejecting head described above.

The ink jet type recording head includes a piezoelectric element on one surface side of a flow-path forming substrate in which a pressure generation chamber communicating with nozzle openings is provided. In the ink jet type recording head, a diaphragm is deformed by driving the piezoelectric element, and thus a pressure in the pressure generation chamber is changed. Therefore, ink droplets are ejected through the nozzles (see JP-A-2009-172878, for example).

In some cases, the diaphragm is bent toward the piezoelectric element side or the pressure generation chamber side when voltage is not applied to the piezoelectric element. Such an initial bent state of the piezoelectric element is caused by various factors, such as a manufacturing process and a forming material.

A bent state of the diaphragm when the piezoelectric element is operated and the diaphragm is deformed to the maximum extent is set to a reached bent state. A difference between a reached bent amount and an initial bent amount is set to a displacement amount.

The greater the initial bent amount of the diaphragm is, the greater the reached bent amount of the diaphragm owing to the piezoelectric element is. However, in this case, a displacement amount does not significantly increase. As described above, the displacement amount does not significantly increase as much as the reached bent amount increasing owing to the deformation of the piezoelectric element. Thus, there is a problem in that efficiency of energy applied to the piezoelectric element is poor, compared to the displacement amount due to the piezoelectric element.

Such a problem is not limited to the ink jet type recording head but common to a liquid ejecting head which ejects liquid other than ink.

SUMMARY

An advantage of some aspects of the invention is to provide a liquid ejecting head and a liquid ejecting apparatus having highly-efficient liquid discharging properties which are realized by efficiently displacing the diaphragm to discharge liquid.

According to an aspect of the invention, there is provided a liquid ejecting head including a flow-path forming substrate including a plurality of pressure generation chambers that communicate with nozzle openings through which liquid is ejected, an actuator device that is provided on the flow-path forming substrate and applies a pressure to the pressure generation chambers via a diaphragm, and a joining substrate that is joined to the flow-path forming substrate and forms a sealed space for sealing the actuator device, in which a pressure in the sealed space is adjusted such that the diaphragm is drawn up to the actuator side or is pressed down to the pressure generation chamber side.

In this case, the initial bent state of the diaphragm is adjusted in such a manner that an inner portion of the sealed space is adjusted to be under the positive pressure condition or the negative pressure condition. Thus, compared to the case where the pressure is not adjusted, it is possible to obtain the adequate displacement amount while reducing a reached bent amount owing to a deformation of the piezoelectric element. Accordingly, it is possible to improve efficiency of the piezoelectric element. Therefore, in the case of the liquid ejecting head according to the invention, the diaphragm is efficiently deformed to discharge liquid as described above, and thus, the liquid ejecting head has highly-efficient liquid-discharging properties.

In the liquid ejecting head, it is preferable that the diaphragm be bent toward the pressure generation chamber side when the actuator device is not operated, the diaphragm be bent toward the pressure generation chamber side when the actuator device is operated, and a pressure in the sealed space be adjusted to be lower than the atmospheric pressure. In this case, the inner portion of the sealed space is set to be under the negative pressure condition, and thus the diaphragm is bent toward the pressure generation chamber side in either case of a non-operation period (the initial bent state) or an operation period (the reached bent state) of the actuator device. Even in this case, compared to the case where the pressure is not adjusted, it is possible to obtain the adequate displacement amount while reducing the reached bent amount owing to the deformation of the piezoelectric element. Accordingly, it is possible to improve the efficiency of the piezoelectric element.

In the liquid ejecting head, it is preferable that the diaphragm be bent toward the actuator device side when the actuator device is not operated, the diaphragm be bent toward the actuator device side when the actuator device is operated, and a pressure in the sealed space be adjusted to be higher than the atmospheric pressure. In this case, the inner portion of the sealed space is set to be under the positive pressure condition, and thus the diaphragm is bent toward the actuator device side in either case of the operation period (the initial bent state) or the non-operation period (the reached bent state) of the actuator device. Even in this case, compared to the case where the pressure is not adjusted, it is possible to obtain the adequate displacement amount while reducing the reached bent amount owing to the deformation of the piezoelectric element. Accordingly, it is possible to improve the efficiency of the piezoelectric element.

In the liquid ejecting head, it is preferable that the diaphragm be bent toward the actuator device side when the actuator device is not operated, the diaphragm be bent toward the pressure generation chamber side when the actuator device is operated, and a pressure in the sealed space be adjusted to be lower than the atmospheric pressure such that, when a joint surface between the flow-path forming substrate and the diaphragm is set to a reference plane, a position of the diaphragm when the actuator device is not operated is set to a first displacement, and a bent position of the diaphragm closest to the pressure generation chamber side when the actuator device is operated is set to a second displacement, the first displacement is equal to or greater than the second displacement. In this case, the inner portion of the sealed space is set to be under the negative pressure condition, and thus the diaphragm is bent toward the actuator device side when the actuator device is not operated (in the initial bent state) and the diaphragm is bent toward the pressure generation chamber side when the actuator device is operated (in the reached bent state). Even in this case, compared to the case where the pressure is not adjusted, it is possible to obtain the adequate displacement amount while reducing the reached bent amount owing to the deformation of the piezoelectric element. Accordingly, it is possible to improve the efficiency of the piezoelectric element.

In the liquid ejecting head, it is preferable that the diaphragm be bent toward the actuator device side when the actuator device is not operated, the diaphragm be bent toward the pressure generation chamber side when the actuator device is operated, and a pressure in the sealed space be adjusted to be higher than the atmospheric pressure such that, when a joint surface between the flow-path forming substrate and the diaphragm is set to a reference plane, a position of the diaphragm when the actuator device is not operated is set to a first displacement, and a bent position of the diaphragm closest to the pressure generation chamber side when the actuator device is operated is set to a second displacement, the second displacement is equal to or greater than the first displacement. In this case, the inner portion of the sealed space is set to be under the positive pressure condition, and thus the diaphragm is bent toward the actuator device side when the actuator device is not operated (in the initial bent state) and the diaphragm is bent toward the pressure generation chamber side when the actuator device is operated (in the reached bent state). Even in this case, compared to the case where the pressure is not adjusted, it is possible to obtain the adequate displacement amount while reducing the reached bent amount owing to the deformation of the piezoelectric element. Accordingly, it is possible to improve the efficiency of the piezoelectric element.

According to another aspect of the invention, there is provided a liquid ejecting apparatus equipped with the liquid ejecting head described above.

In this case, it is possible to provide a liquid ejecting apparatus having highly-efficient liquid discharging properties.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described with reference to accompanying drawings.

Embodiment 1

Figure 1:
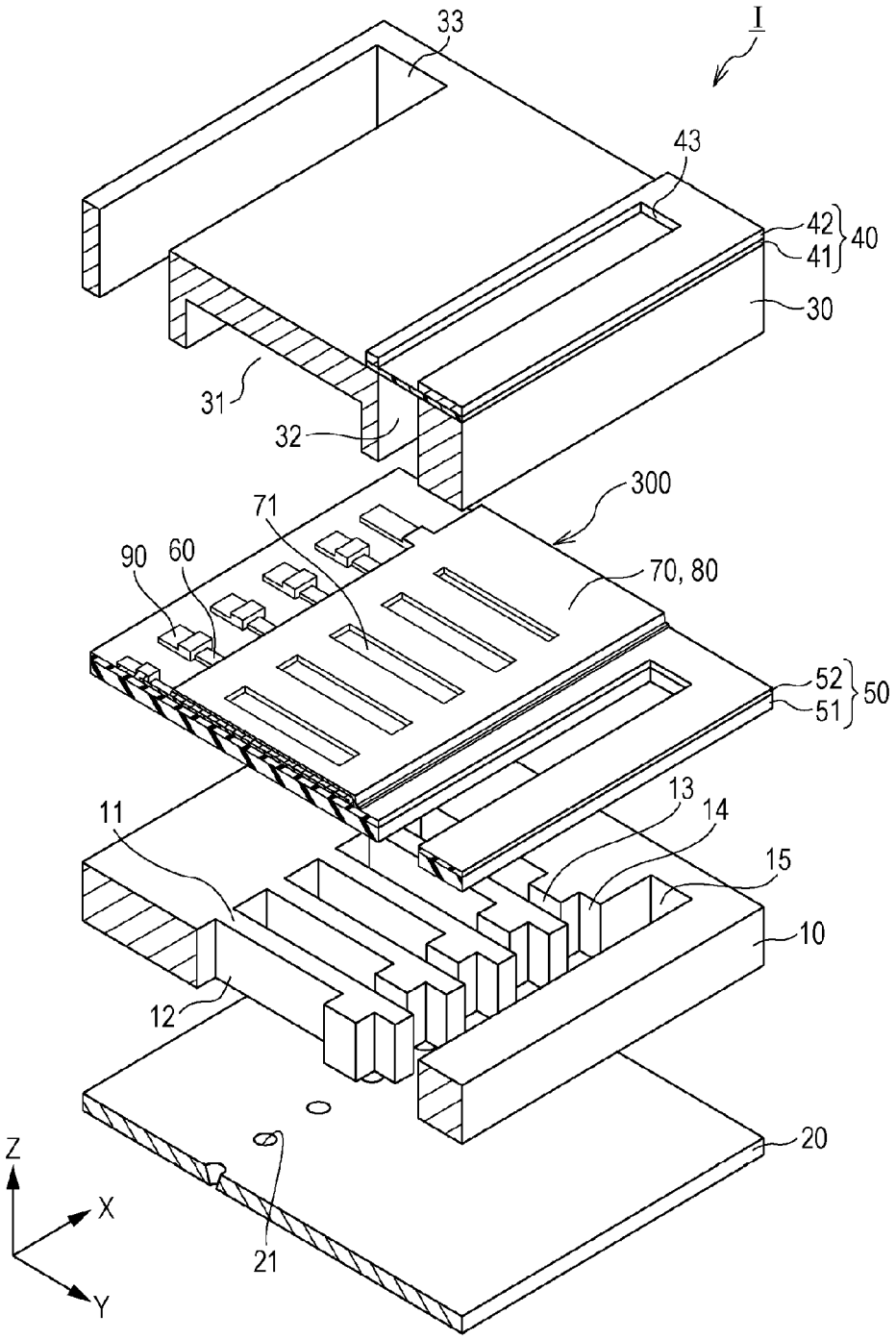
FIG. 1 is a perspective view of an ink jet type recording head according to Embodiment 1.
Figure 2A:
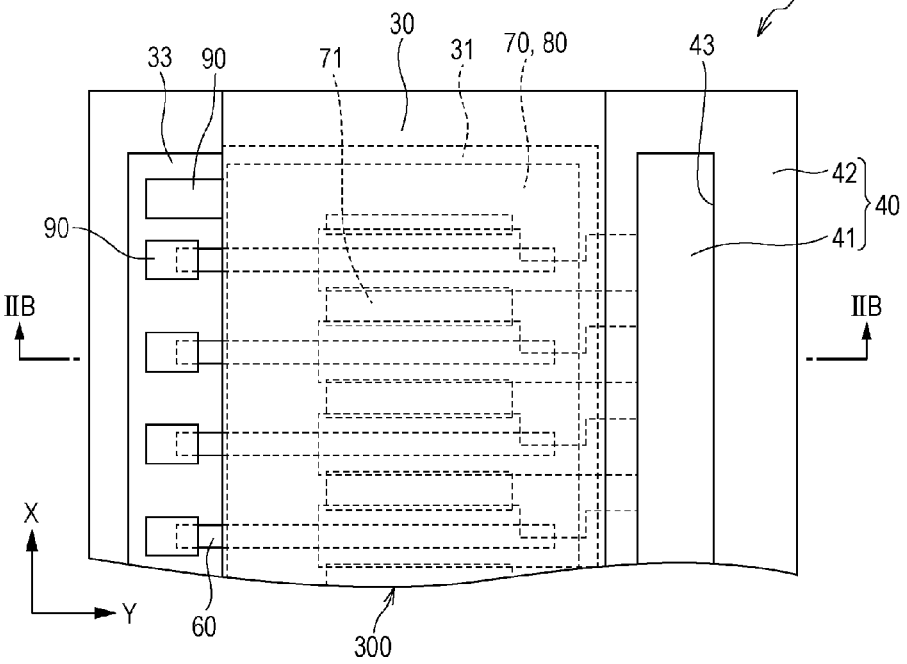
FIGS. 2A and 2B are a plan view and a cross-sectional view of the ink jet type recording head according to Embodiment 1.
Figure 2B:
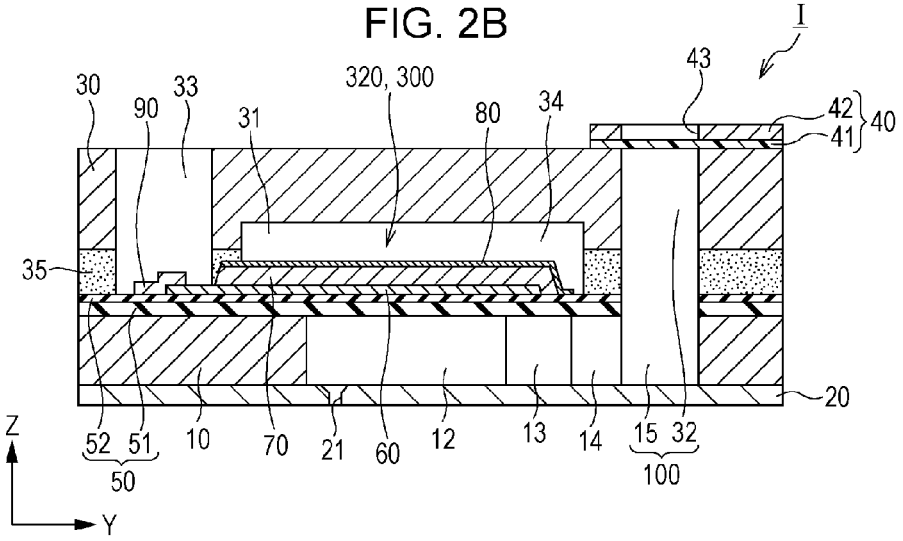

FIG. 1 is a perspective view of an ink jet type recording head as an example of a liquid ejecting head according to Embodiment 1 of the invention. FIGS. 2A and 2B are a plan view and a cross-sectional view of the ink jet type recording head.

An ink jet type recording head I according to Embodiment 1 includes a flow-path forming substrate 10, as illustrated in drawings. Pressure generation chambers 12 which are portioned by a plurality of partition walls 11 are formed in the flow-path forming substrate 10. The pressure generation chambers 12 are aligned in a direction in which a plurality of nozzle openings 21 through which ink is discharged are aligned. Hereinafter, this direction is referred to as an alignment direction of the pressure generation chambers 12 or a first direction X. In addition, a direction which is perpendicular to the first direction X in a plane of the flow-path forming substrate 10 is set to be a second direction Y. Furthermore, a direction which is perpendicular to the first direction X and the second direction Y is set to be a third direction Z. Although one row of the pressure generation chambers 12 aligned in the first direction X is illustrated in the drawings, a plurality of rows of the pressure generation chambers 12 may be aligned in the second direction Y.

In the flow-path forming substrate 10, an ink feeding path 13 and a communication path 14 which are formed on one end portion of the pressure generation chamber 12 in the second direction Y are partioned by a plurality of the partition walls 11. A communication portion 15 which constitutes a part of a manifold 100 functioning a common ink chamber (a liquid chamber) of the pressure generation chambers 12 is formed outside the communication path 14 (on a side opposite the pressure generation chamber 12 in the second direction Y). In other words, a liquid flow path which is constituted by the pressure generation chambers 12, the ink feeding path 13, the communication path 14, and the communication portion 15 is formed in the flow-path forming substrate 10.

A nozzle plate 20 on which nozzle openings 21 communicating with the pressure generation chambers 12 are formed is joined, by an adhesive agent, a thermal welding film, or the like, to one surface side of the flow-path forming substrate 10, that is, a surface to which the liquid flow path, such as the pressure generation chamber 12, is opened.

A diaphragm 50 is formed on the other surface side of the flow-path forming substrate 10. The diaphragm 50 according to Embodiment 1 is constituted by an elastic film 51 formed on the flow-path forming substrate 10 and an insulator film 52 formed on the elastic film 51. Also, a part of the flow-path forming substrate 10, which is processed to be thin, can be used as an elastic film of the diaphragm. The liquid flow path, such as the pressure generation chamber 12, is formed in such a manner that one surface of the flow-path forming substrate 10 is subjected to anisotropic etching. The diaphragm 50 (the elastic film 51) is provided on the other surface side of the liquid flow path, such as the pressure generation chamber 12.

A piezoelectric element 300 which is constituted by a first electrode 60, a piezoelectric layer 70, and a second electrode 80 is formed on the insulator film 52. In Embodiment 1, this piezoelectric element 300 provided on the flow-path forming substrate 10 functions as an actuator device.

The first electrode 60 is separated to correspond to each pressure generation chamber 12. The first electrode 60 forms an individual electrode which is separated for each piezoelectric element 300. In the first direction X of the pressure generation chamber 12, a width of the first electrode 60 is smaller than the width of the pressure generation chamber 12. In other words, in the first direction X of the pressure generation chamber 12, an end portion of the first electrode 60 is located within an area facing the pressure generation chamber 12. In the second direction Y of the pressure generation chamber 12, both end portions of the first electrode 60 extend outside the pressure generation chamber 12. Material forming the first electrode 60 is not particularly limited as long as the material is a metallic material, conductive oxide, or a laminated material of these. Examples of the material forming the first electrode 60 include metal, such as Ti, Pt, Ta, Ir, Sr, In, Sn, Au, Al, Fe, Cr, Ni, and Cu, material which is any one of the above-mentioned materials, or a mixture or a laminated material of two or more materials mentioned above, conductive oxide, such as $LaNiO_3$, $SrRuO_3$ or a laminated material of the above-mentioned conductive oxide and a metallic material.

The piezoelectric layer 70 continuously extends in the first direction X with a predetermined width in the second direction Y. A width of the piezoelectric layer 70 in the second direction Y is greater than a length of the pressure generation chamber 12 in the second direction Y. Thus, in the second direction Y of the pressure generation chamber 12, the piezoelectric layer 70 extends outside the pressure generation chamber 12.

In addition, concave portions 71 which respectively correspond to the partition walls 11 are formed in the piezoelectric layer 70. The piezoelectric layer 70 continuously extends, in first direction X, over the pressure generation chambers 12. Parts of the piezoelectric layer 70, which respectively face the partition walls 11, are removed to form the concave portions 71. This concave portion 71 suppresses rigidity of a part (an arm of the diaphragm 50) of the diaphragm 50, which faces an end portion of the pressure generation chamber 12 in a width direction. Accordingly, it is possible to easily displace the piezoelectric element 300.

An end portion of the piezoelectric layer 70, which is located on one end portion side (an ink feeding path 13 side, in Embodiment 1) of the pressure generation chamber 12 in the second direction Y, is positioned further outside than an end portion of the first electrode 60. In other words, the end portion of the first electrode 60 is covered with the piezoelectric layer 70. An end portion of the piezoelectric layer 70, which is located on the other end side of the pressure generation chamber 12 in the second direction Y, is positioned further inside (a pressure generation chamber 12 side) than an end portion of the first electrode 60.

A lead electrode 90 which is formed of, for example, gold (Au) is connected to the first electrode 60 which extends outside the piezoelectric layer 70. Although not illustrated, this lead electrode 90 forms a terminal portion to which connection wiring connected to a driving circuit or the like is connected.

An example of the piezoelectric layer 70 includes a perovskite-structured crystalline film (a perovskite type crystal) which is formed on the first electrode 60, operates an electromechanical conversion, and is formed from a ferroelectric ceramics material. Examples of material forming the piezoelectric layer 70 include a ferroelectric piezoelectric material, such as lead zirconate titanate (PZT), and the ferroelectric piezoelectric material to which metal oxide, such as niobium oxide, nickel oxide, and magnesium oxide is added. Specifically, it is possible to use lead titanate ($PbTiO_3$), lead zirconate titanate ($Pb(Zr,Ti)O_3$), lead zirconate ($PbZrO_3$), lead lanthanum titanate ($(Pb,La),TiO_3$), lead lanthanum zirconate titanate($(Pb,La)(Zr,Ti)O_3$), magnesium niobate lead zirconium titanate ($Pb(Zr,Ti)(Mg,Nb)O_3$) or the like. In Embodiment 1, the piezoelectric layer 70 is formed from lead zirconate titanate (PZT).

In addition, the material forming the piezoelectric layer 70 is not limited to a lead-based piezoelectric material which contains lead, but non-lead-based piezoelectric material which does not contain lead can be applied. Examples of the non-lead-based piezoelectric material include bismuth ferrite (($BiFeO_3$), referred to as "BFO" as an abbreviation), barium titanate (($BaTiO_3$), referred to as "BT" as an abbreviation), potassium sodium niobate ($(K,Na)(NbO_3)$, referred to as "KNN" as an abbreviation), potassium sodium niobate lithium ($(K,Na,Li)(NbO_3)$), niobate tantalate potassium sodium lithium ($(K,Na,Li)(Nb,Ta)O_3$), bismuth potassium titanate ($(Bi_{1/2}K_{1/2})TiO_3$, referred to as "BKT" as an abbreviation), sodium bismuth titanate ($(Bi_{1/2}Na_{1/2})TiO_3$, referred to as "BNT" as an abbreviation), manganic acid bismuth ($BiMnO_3$, referred to as "BM" as an abbreviation), composite oxide ($x[(Bi_xK_{1-x})TiO_3]-(1-x)[BiFeO_3]$, referred to as "BKT-BF" as an abbreviation) which contains bismuth, potassium, titanium and iron and has a perovskite structure, composite oxide ($(1-x)[(BiFeO_3]-x[BaTiO_3]$, referred to as "BFO-BT" as an abbreviation) which contains bismuth, iron, barium, and titanium and has a perovskite structure, and a material obtained by adding metal, such as manganese, cobalt, and chromium, to the material mentioned above ($(1-x)[(Bi(Fe_{1-y}M_y)O_3]-x[BaTiO_3]$ (M is Mn, Co or Cr)).

The second electrode 80 is provided on the piezoelectric layer 70 to continuously extend in the first direction X of the pressure generation chamber 12 and forms a common electrode of a plurality of the piezoelectric elements 300. Material forming the second electrode 80 is not particularly limited to metallic material, conductive oxide, or a laminated material of these and the same material forming the first electrode 60 can be applied.

An end portion of the second electrode 80, which is located on one end side of the pressure generation chamber 12 in the second direction Y, is positioned further outside than the end portion of the piezoelectric layer 70. That is, the end portion of the piezoelectric layer 70 is covered with the second electrode 80. An end portion of the second electrode 80, which is located on the other end side of the pressure generation chamber 12 in the second direction Y, is positioned further inside (a pressure generation chamber 12 side) than the end portion of the piezoelectric layer 70.

The piezoelectric element 300 configured as above is displaced when voltage is applied between the first electrode 60 and the second electrode 80. In other words, piezoelectric distortion of the piezoelectric layer 70 which is interposed between the first electrode 60 and the second electrode 80 is caused by applying voltage between both electrodes. A part of the piezoelectric layer 70, which is piezoelectrically distorted when the voltage is applied between both electrodes, is referred to as an active portion 320. On the contrary, a part of the piezoelectric layer 70, which is not piezoelectrically distorted, is referred to as a non-active portion. Furthermore, in the active portion 320 which is a piezoelectrically-distortable portion of the piezoelectric layer 70, a portion which faces the pressure generation chamber 12 is referred to as a bendable portion and a portion which is located outside the pressure generation chamber 12 is referred to as a non-bendable portion.

In Embodiment 1, all of the first electrode 60, the piezoelectric layer 70, and the second electrode 80 continuously extend outside the pressure generation chamber 12, in the second direction Y of the pressure generation chamber 12. In other words, the active portion 320 continuously extends outside the pressure generation chamber 12. Thus, a part of the active portion 320, which faces the pressure generation chamber 12 of the piezoelectric element 300, is the bendable portion and a part thereof, which is located outside the pressure generation chamber 12, is the non-bendable portion.

A protection substrate 30 which is an example of a joining substrate is joined, by an adhesive agent 35, to an upper portion of the flow-path forming substrate 10, on which the piezoelectric element 300 is formed.

The protection substrate 30 is a member to protect the piezoelectric element 300. A piezoelectric element holding portion 31 which is a concave portion is provided in the protection substrate 30. The piezoelectric element 300 (the active portion 320) is sealed in a sealed space 34 which is formed by the piezoelectric element holding portion 31 and the flow-path forming substrate 10. A pressure in the sealed space 34 is adjusted to a predetermined value, and thus this allows the diaphragm 50 to be effectively displaced by the piezoelectric element 300. Detail of this aspect will be described below.

Furthermore, a manifold portion 32 which constitutes a part of the manifold 100 is formed in the protection substrate 30. The manifold portion 32 passes through the protection substrate 30 in a thickness direction and extends in a width direction of the pressure generation chamber 12. The manifold portion 32 communicates with the communication portion 15 of the flow-path forming substrate 10, as described above. In addition, a through-hole 33 which passes through the protection substrate 30 in a thickness direction is formed in the protection substrate 30. The lead electrode 90 which is connected to each first electrode 60 of the piezoelectric element 300 is exposed to an inside of the through-hole 33. In the through-hole 33, one end of the connection wiring which is connected to a driving circuit (not illustrated) is connected to lead electrode 90 which is connected to each first electrode 60 of the piezoelectric element 300.

A compliance substrate 40 which is constituted by a sealing film 41 and a fixing plate 42 is joined to an upper portion of the protection substrate 30. The sealing film 41 is formed from a flexible material having low rigidity. One surface of the manifold portion 32 is sealed by the sealing film 41. Furthermore, the fixing plate 42 is formed of hard material, such as metal. A part of the fixing plate 42, which is opposite the manifold 100, is completely removed in the thickness direction, and thus an opening portion 43 is formed. Thus, one surface of the manifold 100 is sealed by only the sealing film 41 having flexibility.

In the ink jet type recording head I of Embodiment 1, the ink is fed through an ink inlet port connected with an external ink feeding unit (not illustrated), and thus the liquid flow path which runs from the manifold 100 to the nozzle openings 21 is filled with the ink. Then, voltage is applied between the first electrode 60 which corresponds to each pressure generation chamber 12 and the second electrode 80, in response to a recording signal from the driving circuit. As a result, the piezoelectric element 300 and the diaphragm 50 are flexibly deformed, and thus the pressure in each pressure generation chamber 12 increases. Therefore, ink droplets are ejected through the respective nozzle openings 21.

Here, details of a pressure in the sealed space 34, which is formed by the piezoelectric element holding portion 31 and the flow-path forming substrate 10, and the diaphragm 50 will be described.

Figure 3A:
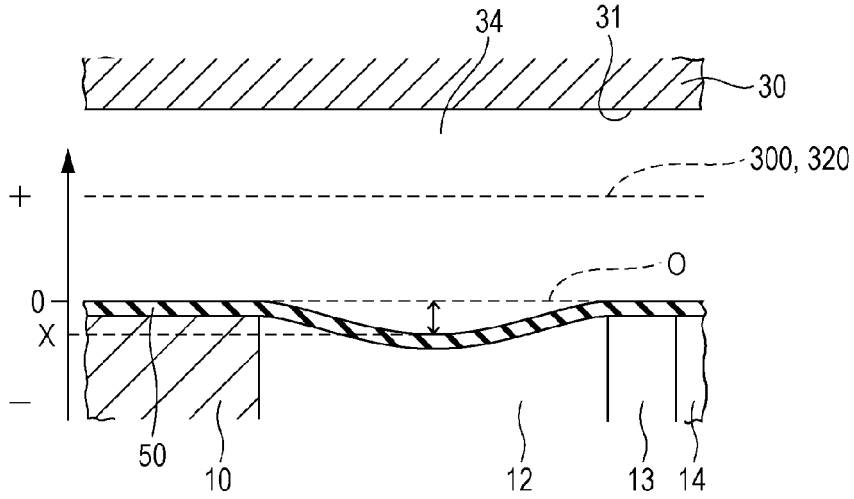
FIGS. 3A and 3B are enlarged cross-sectional views of principal portions of a piezoelectric element in a sealed space.
Figure 3B:
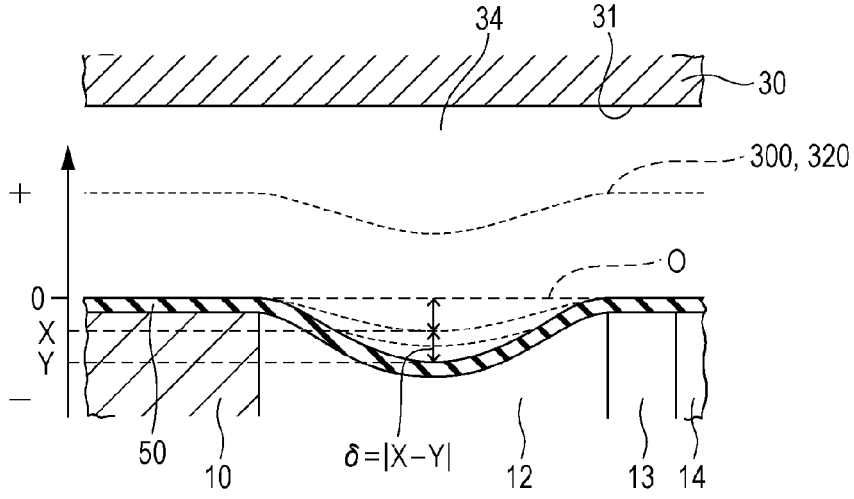

FIGS. 3A and 3B are enlarged cross-sectional views of principal portions of a piezoelectric element in the sealed space. The piezoelectric element 300 is illustrated by the dotted line. The piezoelectric element 300 in a state where voltage is not applied is illustrated in FIG. 3A. The piezoelectric element 300 is sealed in the sealed space 34. The sealed space 34 is an enclosed space which is isolated from the atmosphere. A pressure in the sealed space 34 is adjusted to the predetermined pressure as described below.

A part of the diaphragm 50, which faces the pressure generation chamber 12, is bent toward the pressure generation chamber 12 side. A bent state of the diaphragm 50 when the piezoelectric element 300 is not operated (when voltage is not applied) is referred to as an initial bent state.

A joint surface between the diaphragm 50 and the flow-path forming substrate 10 is set to a reference plane O. A position of the diaphragm 50 in an initial-bent state with respect to the reference plane O is set to a first displacement X. In other words, in a direction perpendicular to the reference plane O, the first displacement X is a position (a length from the reference plane O to an apex of a bent portion) of the apex of the diaphragm 50 in the initial-bent state, which is the most bent portion, with the reference plane O as a reference position.

The first displacement X when the diaphragm 50 is bent toward the piezoelectric element 300 side is set to be a positive position. The first displacement X when the diaphragm 50 is bent toward the pressure generation chamber 12 side is set to be a negative position.

The piezoelectric element 300 in a state where voltage is applied and the piezoelectric element 300 is most bent is illustrated in FIG. 3B. A bent state of the diaphragm 50 when the piezoelectric element 300 is operated and most bent is referred to as a reached bent state.

A position of the diaphragm 50 in a reached-bent state with respect to the reference plane O is set to a second displacement Y. In other words, in the direction perpendicular to the reference plane O, the second displacement Y is a position (a length from the reference plane O to an apex of a bent portion) of the apex of the diaphragm 50 in the reached-bent state, which is the most bent portion, with the reference plane O as the reference position.

An absolute value of a difference between the first displacement X and the second displacement Y is set to a displacement amount δ. FIGS. 3A and 3B illustrate a case where both the first displacement X and the second displacement Y are located at a negative position. However, even when both displacements are located at a positive position or when one of the displacements is located at a positive position and the other one is located at a negative position, the displacement amount δ is defined in the same manner.

Figure 4:
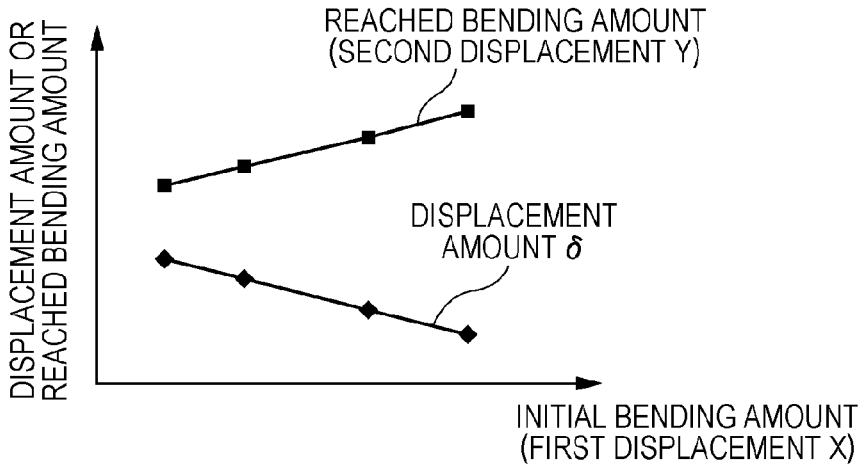
FIG. 4 is a schematic view illustrating a relationship between an initial bent amount, a reached bent amount, and a displacement amount.

FIG. 4 is a schematic view illustrating a relationship between an initial bent amount (the first displacement X), a reached bent amount (the second displacement Y), and the displacement amount δ. A horizontal axis shows the initial bent amount, that is, a degree of the first displacement X. A vertical axis shows the reached bent amount, that is, a degree of the second displacement Y or the displacement amount.

The greater the value on the axis is, the greater the degree of the diaphragm 50 bent toward the pressure generation chamber 12 side is.

The greater the initial bent amount of the diaphragm 50 is, the greater the reached bent amount is, as illustrated in FIG. 4. On the contrary, the greater the initial bent amount of the diaphragm 50 is, the smaller the displacement amount δ is.

As described above, if the initial bent amount of the diaphragm 50 is great, that is, the initial bent position is separated from the reference plane O, the reached bent amount owing to the piezoelectric element 300 is great. However, the displacement amount δ does not increase. As described above, the displacement amount δ does not increase even when the reached bent amount increases by the deformation of the piezoelectric element 300. For this reason, in a state where the initial bent amount is great, when the piezoelectric element 300 is operated to obtain the displacement amount, the operation efficiency is poor. This is also common in a case where the initial bent position of the diaphragm 50 is located on the piezoelectric element 300 side.

Figure 5:
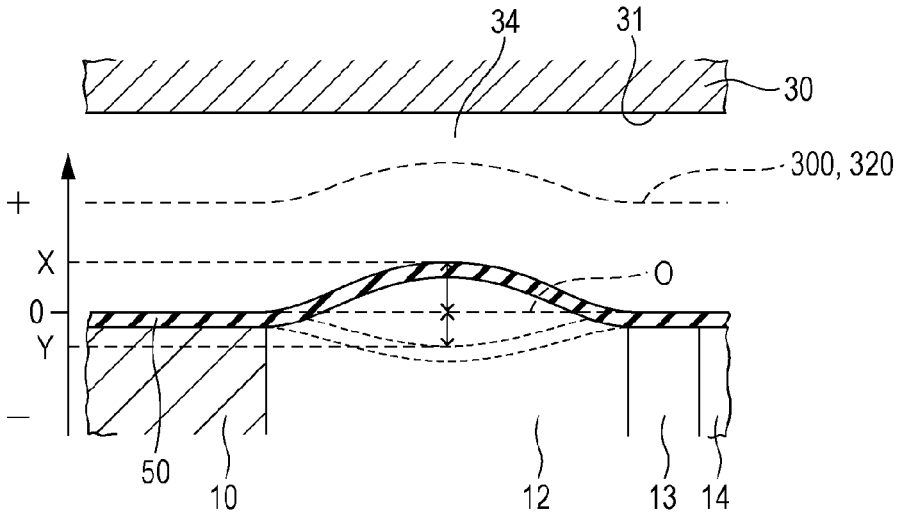
FIG. 5 is an enlarged cross-sectional view of the principal portions of the piezoelectric element in the sealed space.

Here, the ink jet type recording head I according to Embodiment 1 can ensure the adequate displacement amount δ and can improve the operation efficiency by adjusting the initial bent position of the diaphragm 50, as illustrated in FIG. 5.

FIG. 5 is an enlarged cross-sectional view of the principal portions of the piezoelectric element in the sealed space. The piezoelectric element 300 is illustrated by the dotted line.

The diaphragm 50 in an initial bent state is bent toward the piezoelectric element 300 side, as illustrated in FIG. 5. On the contrary, the diaphragm 50 in a reached bent state is bent toward the pressure generation chamber 12 side. In this case, the initial bent position and the reached bent position are symmetric with respect to the reference plane O.

The displacement amount δ which is a difference between the first displacement X in the initial bent state and the second displacement Y in the reached bent state is the same as those illustrated in FIG. 3B. However, the first displacement X is located on the piezoelectric element 300 side, the amount of the second displacement Y is smaller than that illustrated in FIG. 3B.

The smaller the initial bent amount is, the greater the displacement amount δ when the diaphragm 50 is deformed is, as illustrated in FIG. 4. Accordingly, even in a case where the reached bent amount (the second displacement Y) owing to the deformation of the piezoelectric element 300 is small, it is possible to obtain the adequate displacement amount δ. Thus, it is possible to improve the efficiency of the piezoelectric element 300.

Ideally, it is the most efficient and preferable that the initial bent position and the reached bent position of the diaphragm 50 be symmetric with respect to the reference plane O interposed therebetween, as illustrated in FIG. 5. However, the configuration is not limited thereto, it is sufficient as long as the initial bent state of the diaphragm 50 is adjusted such that the initial bent position and the reached bent position are substantially symmetric with respect to the reference plane O interposed therebetween.

Adjustment of the initial bent state of the diaphragm 50 can be performed in such a manner that the pressure in the sealed space 34 is set to be (a positive pressure) higher than the atmospheric pressure or set to be (a negative pressure) lower than the atmospheric pressure. In a case where an inner portion of the sealed space 34 is under the positive pressure condition, the diaphragm 50 in the initial bent state can be bent toward the pressure generation chamber 12 side. In a case where the inner portion of the sealed space 34 is under the negative pressure condition, the diaphragm 50 in the initial bent state can be bent toward the piezoelectric element 300 side.

A method for setting the inner portion of the sealed space 34 to be under the positive pressure condition is as follows, for example. First, the flow-path forming substrate 10 on which the piezoelectric element 300 or the like is formed is joined, under an inert gas atmosphere with a pressure higher than the atmospheric pressure, to the protection substrate 30 to form the sealed space 34. Then, an environmental pressure is returned to the atmosphere pressure, and thus it is possible to adjust the inner portion of the sealed space 34 to be under the positive pressure condition. A method for setting the inner portion of the sealed space 34 to be under the negative pressure condition is as follows, for example. First, the flow-path forming substrate 10 on which the piezoelectric element 300 or the like is formed is joined, under (a vacuum state or) an atmosphere with a pressure lower than the atmospheric pressure, to the protection substrate 30 to form the sealed space 34. Then, an environmental pressure is returned to the atmosphere pressure, and thus it is possible to adjust the inner portion of the sealed space 34 to be under the negative pressure condition.

Figure 6A:
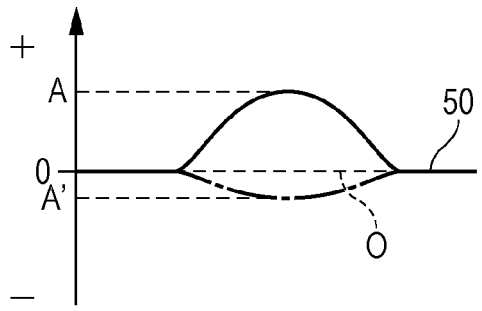
FIGS. 6A and 6B are schematic views illustrating a state of a diaphragm, in which an inner portion of the sealed space is under the atmospheric pressure condition or a pressure in the sealed space is adjusted.
Figure 6B:
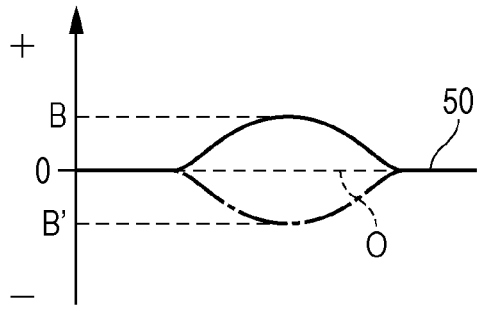

The initial bent state of the diaphragm 50 is adjusted based on a state of the diaphragm 50 where the inner portion of the sealed space 34 is under the atmospheric pressure condition. Before describing a pressure adjustment of the inner portion of the sealed space 34 case by case, FIGS. 6A and 6B are referred. FIGS. 6A and 6B schematically illustrate bent states of the diaphragm in which the pressure in the sealed space is not adjusted or is adjusted.

FIG. 6A illustrates a state of the diaphragm 50 when the inner portion of the sealed space 34 is under the atmospheric pressure condition. In FIG. 6A, the solid line shows the initial bent state of the diaphragm 50 and A shows the first displacement (hereinafter referred to as a first displacement A). The dashed line illustrated in FIG. 6A shows the reached bent state of the diaphragm 50 and A' shows a second displacement (hereinafter referred to as a second displacement A').

FIG. 6B illustrates a state of the diaphragm 50 when the pressure in the sealed space 34 is adjusted to be a positive value or a negative value. In FIG. 6B, the solid line shows the initial bent state of the diaphragm 50 and B shows the first displacement (hereinafter referred to as a first displacement B). The dashed line illustrated in FIG. 6B shows the reached bent state of the diaphragm 50 and B' shows a second displacement (hereinafter referred to as a second displacement B').

Meanings of a positive state and a negative state of the first displacement A, the second displacement A', the first displacement B, and the second displacement B' are the same as those in FIG. 5. Hereinafter, the diaphragm in a state where the pressure in the sealed space 34 is not adjusted or adjusted will be schematically illustrated with the reference signs described above.

1. When First Displacement A is Negative Value (A<0) and Second Displacement A' is Negative Value (A'<0)

Figure 7A:
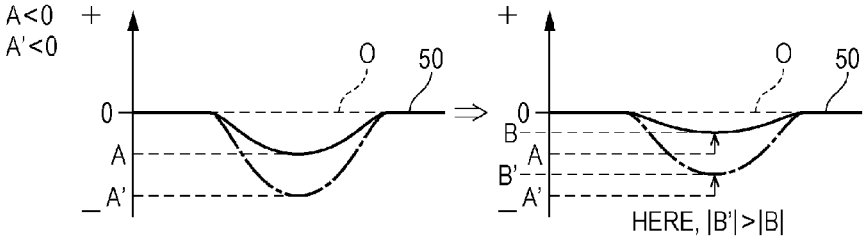
FIGS. 7A and 7B are schematic views illustrating the diaphragm in a state where the pressure in the sealed space is not adjusted or is adjusted.

In this case, when the inner portion of the sealed space 34 is under the atmospheric pressure condition, the diaphragm 50 is bent toward the pressure generation chamber 12 side in either case of the initial bent state or the reached bent state, as illustrated in the left drawing of FIG. 7A.

In this case, the inner portion of the sealed space 34 is set to be under the negative pressure condition, as illustrated in the right drawing of FIG. 7A. The pressure in the sealed space 34 is adjusted to a negative value, and thus the diaphragm 50 is drawn up to the piezoelectric element 300 side. In other words, the first displacement B in the initial bent state is positioned further on the piezoelectric element 300 side than the first displacement A in a state where the pressure is not adjusted.

The pressure is adjusted, and thus the first displacement A of the diaphragm 50 moves to the first displacement B. Therefore, to ensure the same displacement amount δ as the displacement amount δ which is not subjected to the pressure adjustment, the second displacement B' in the reached bent state, which is subjected to the pressure adjustment, can be positioned further on the piezoelectric element 300 side than the second displacement A' in the reached bent state, which is not subjected to the pressure adjustment. In other words, it is possible to obtain the same displacement amount δ as the displacement amount δ which is not subjected to the pressure adjustment, even when the second displacement B' which is subjected to the pressure adjustment is (moves close to the reference plane O) set to be smaller than the second displacement A' which is not subjected to the pressure adjustment.

As described above, it is possible to ensure the same displacement amount δ as the displacement amount δ which is not subjected to the pressure adjustment even when the second displacement B' in the reached bent state is set to be smaller than the displacement which is not subjected to the pressure adjustment. Thus, it is possible to effectively drive the piezoelectric element 300.

Ideally, it is preferable that the inner portion of the sealed space 34 be under the negative pressure condition such that the initial bent position and the reached bent position are symmetric with respect to the reference plane O interposed therebetween. It is sufficient as long as, at the least, the first displacement B and the second displacement B' of the diaphragm 50, which are subjected to the pressure adjustment, are positioned further on the piezoelectric element 300 side than the first displacement A and the second displacement A' which is not subjected to the pressure adjustment. However, the absolute value |B'| of the second displacement B' which is subjected to the pressure adjustment is set to be greater than the absolute value |B| of the first displacement B. The reason for this is as follows. When, on the contrary, the absolute value |B| is set to be greater than the absolute value |B'|, the initial bent state of the diaphragm 50 which is subjected to the pressure adjustment shows a state where the diaphragm 50 is greatly bent toward the piezoelectric element 300 side.

2. When First Displacement A is Positive Value (A>0) and Second Displacement A' is Positive Value (A'>0)

Figure 7B:
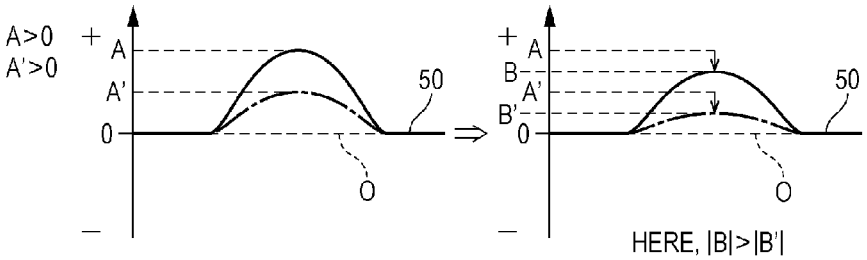

In this case, when the inner portion of the sealed space 34 is under the atmospheric pressure condition, the diaphragm 50 is bent toward the piezoelectric element 300 side in either case of the initial bent state or the reached bent state, as illustrated in the left drawing of FIG. 7B.

In this case, the inner portion of the sealed space 34 is set to be under the positive pressure condition, as illustrated in the right drawing of FIG. 7B. The pressure in the sealed space 34 is adjusted to a positive value, and thus the diaphragm 50 is drawn to the pressure generation chamber 12 side. In other words, the first displacement B in the initial bent state is positioned further on the pressure generation chamber 12 side (the reference plane O side) than the first displacement A in a state where the pressure is not adjusted.

The pressure is adjusted, and thus the first displacement A of the diaphragm 50 moves to the first displacement B. Therefore, to ensure the same displacement amount δ as the displacement amount δ which is not subjected to the pressure adjustment, the second displacement B' in the reached bent state, which is subjected to the pressure adjustment, can be positioned further on the pressure generation chamber 12 side than the second displacement A' in the reached bent state, which is not subjected to the pressure adjustment. In other words, it is possible to obtain the same displacement amount δ as the displacement amount δ which is not subjected to the pressure adjustment, even when the second displacement B' subjected to the pressure adjustment is (moves close to the reference plane O) set to be smaller than the second displacement A' which is not subjected to the pressure adjustment.

As described above, it is possible to ensure the same displacement amount δ as the displacement amount δ which is not subjected to the pressure adjustment even when the first displacement B in the initial bent state is set to be smaller than the displacement which is not subjected to the pressure adjustment. Thus, it is possible to effectively drive the piezoelectric element 300.

Ideally, it is preferable that the inner portion of the sealed space 34 be under the positive pressure condition such that the initial bent position and the reached bent position are symmetric with respect to the reference plane O interposed therebetween. It is sufficient as long as, at the least, the first displacement B and the second displacement B' of the diaphragm 50, which are subjected to the pressure adjustment, are positioned further on the pressure generation chamber 12 side than the first displacement A and the second displacement A' which is not subjected to the pressure adjustment. However, the absolute value |B| of the second displacement B which is subjected to the pressure adjustment is set to be greater than the absolute value |B'| of the first displacement B'. The reason for this is as follows. When, on the contrary, the absolute value |B'| is set to be greater than the absolute value |B|, the initial bent state of the diaphragm 50 which is subjected to the pressure adjustment shows a state where the diaphragm 50 is greatly bent toward the pressure generation chamber 12 side.

3. When First Displacement A is Positive Value (A>0), Second Displacement A' is Negative Value (A'<0), and Absolute Value of Second Displacement A' is greater than Absolute Value of First Displacement A (|A'|>|A|)

Figure 8A:
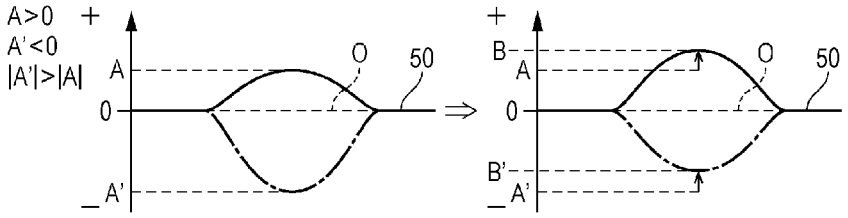
FIGS. 8A and 8B are schematic views illustrating the diaphragm in a state where the pressure in the sealed space is not adjusted or is adjusted.

In this case, when the inner portion of the sealed space 34 is under the atmospheric pressure condition, the diaphragm 50 in the initial bent state is bent toward the piezoelectric element 300 side and the diaphragm 50 in the reached bent state is bent toward the pressure generation chamber 12 side, as illustrated in the left drawing of FIG. 8A. In addition, the absolute value of the displacement (the absolute value |A'| of the second displacement A') in the reached bent state is greater than the absolute value of the displacement in the initial bent state (the absolute value |A| of the first displacement A).

In this case, the inner portion of the sealed space 34 is set to be under the negative pressure condition, as illustrated in the right drawing of FIG. 8A. The pressure in the sealed space 34 is adjusted to a negative value, and thus the diaphragm 50 is drawn up to the piezoelectric element 300 side. In other words, the first displacement B in the initial bent state is positioned further on the piezoelectric element 300 side than the first displacement A in a state where the pressure is not adjusted.

The pressure is adjusted, and thus the first displacement A of the diaphragm 50 moves to the first displacement B. Therefore, to ensure the same displacement amount δ as the displacement amount δ which is not subjected to the pressure adjustment, the second displacement B' in the reached bent state, which is subjected to the pressure adjustment, can be positioned further on the piezoelectric element 300 side than the second displacement A' in the reached bent state, which is not subjected to the pressure adjustment. In other words, it is possible to obtain the same displacement amount δ as the displacement amount δ which is not subjected to the pressure adjustment, even when the second displacement B' which is subjected to the pressure adjustment is (moves close to the reference plane O) set to be smaller than the second displacement A' which is not subjected to the pressure adjustment.

As described above, it is possible to ensure the same displacement amount δ as the displacement amount δ which is not subjected to the pressure adjustment even when the second displacement B' in the reached bent state is set to be smaller than the displacement which is not subjected to the pressure adjustment. Thus, it is possible to effectively drive the piezoelectric element 300.

Ideally, it is preferable that the inner portion of the sealed space 34 be under the negative pressure condition such that the initial bent position and the reached bent position are symmetric with respect to the reference plane O interposed therebetween. It is sufficient as long as, at the least, the first displacement B and the second displacement B' of the diaphragm 50, which are subjected to the pressure adjustment, are positioned further on the piezoelectric element 300 side than the first displacement A and the second displacement A' which is not subjected to the pressure adjustment. However, the absolute value |B'| of the second displacement B' which is subjected to the pressure adjustment is set to be greater than the absolute value |B| of the first displacement B. The reason for this is as follows. When, on the contrary, the absolute value |B| is set to be greater than the absolute value |B'|, the initial bent state of the diaphragm 50 which is subjected to the pressure adjustment shows a shape where the diaphragm 50 is greatly bent toward the piezoelectric element 300 side.

4. When First Displacement A is Positive Value (A>0), Second Displacement A' is Negative Value (A'<0), and Absolute Value of First Displacement A is greater than Absolute Value of Second Displacement A' (|A|>|A'|)

Figure 8B:
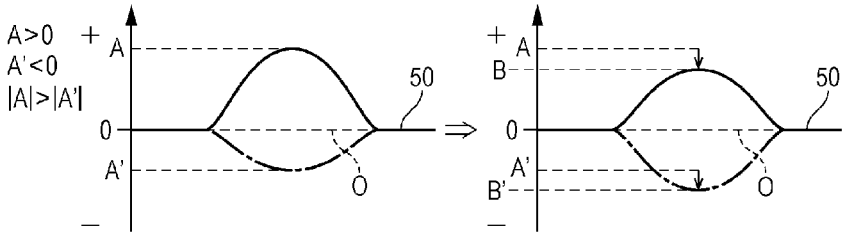

In this case, when the inner portion of the sealed space 34 is under the atmospheric pressure condition, the diaphragm 50 in the initial bent state is bent toward the piezoelectric element 300 side and the diaphragm 50 in the reached bent state is bent toward the pressure generation chamber 12 side, as illustrated in the left drawing of FIG. 8B. In addition, the absolute value of the displacement (the absolute value |A| of the first displacement A) in the initial bent state is greater than the absolute value of the displacement in the reached bent state (the absolute value |A'| of the second displacement A').

In this case, the inner portion of the sealed space 34 is set to be under the positive pressure condition, as illustrated in the right drawing of FIG. 8B. The pressure in the sealed space 34 is adjusted to a positive value, and thus the diaphragm 50 is drawn to the pressure generation chamber 12 side. In other words, the first displacement B in the initial bent state is positioned further on the pressure generation chamber 12 side (the reference plane O) than the first displacement A in a state where the pressure is not adjusted.

The pressure is adjusted, and thus the first displacement A of the diaphragm 50 moves to the first displacement B. Therefore, to ensure the same displacement amount δ as the displacement amount δ which is not subjected to the pressure adjustment, the second displacement B' in the reached bent state, which is subjected to the pressure adjustment, can be positioned further on the pressure generation chamber 12 side than the second displacement A' in the reached bent state, which is not subjected to the pressure adjustment. In other words, it is possible to obtain the same displacement amount δ as the displacement amount δ which is not subjected to the pressure adjustment, even when the second displacement B which is subjected to the pressure adjustment is (moves close to the reference plane O) set to be smaller than the second displacement A which is not subjected to the pressure adjustment.

As described above, it is possible to ensure the same displacement amount δ as the displacement amount δ which is not subjected to the pressure adjustment even when the first displacement B in the initial bent state is set to be smaller than the displacement which is not subjected to the pressure adjustment. Thus, it is possible to effectively drive the piezoelectric element 300.

Ideally, it is preferable that the inner portion of the sealed space 34 be under the positive pressure condition such that the initial bent position and the reached bent position are symmetric with respect to the reference plane O interposed therebetween. It is sufficient as long as, at the least, the first displacement B and the second displacement B' of the diaphragm 50, which are subjected to the pressure adjustment, are positioned further on the pressure generation chamber 12 side than the first displacement A and the second displacement A' which is not subjected to the pressure adjustment. However, the absolute value |B| of the second displacement B which is subjected to the pressure adjustment is set to be greater than the absolute value |B'| of the first displacement B'. The reason for this is as follows. When, on the contrary, the absolute value |B'| is set to be greater than the absolute value |B|, the initial bent state of the diaphragm 50 which is subjected to the pressure adjustment shows a shape where the diaphragm 50 is greatly bent toward the pressure generation chamber 12 side.

As described in the aspects 1 to 4, the initial bent state of the diaphragm 50 is adjusted in such a manner that the inner portion of the sealed space 34 is adjusted to be under the positive pressure condition or the negative pressure condition. Thus, compared to the case where the pressure is not adjusted, it is possible to obtain the adequate displacement amount δ while reducing the reached bent amount owing to the deformation of the piezoelectric element 300. Accordingly, it is possible to improve the efficiency of the piezoelectric element 300.

In the ink jet type recording head I according to Embodiment 1, the diaphragm 50 is efficiently deformed to discharge the ink, as described above. Thus, the ink jet type recording head I has highly-efficient ink-discharging properties.

Embodiment 2

The sealed space 34 according to Embodiment 1 is formed by joining the flow-path forming substrate 10 to the protection substrate 30 using the adhesive agent 35. However, the aspect of the sealed space 34 is not limited thereto. To improve a sealability of the sealed space, a sealed space may be formed by applying a direct joining method using a metallic member, not using the adhesive agent 35.

Figure 9:
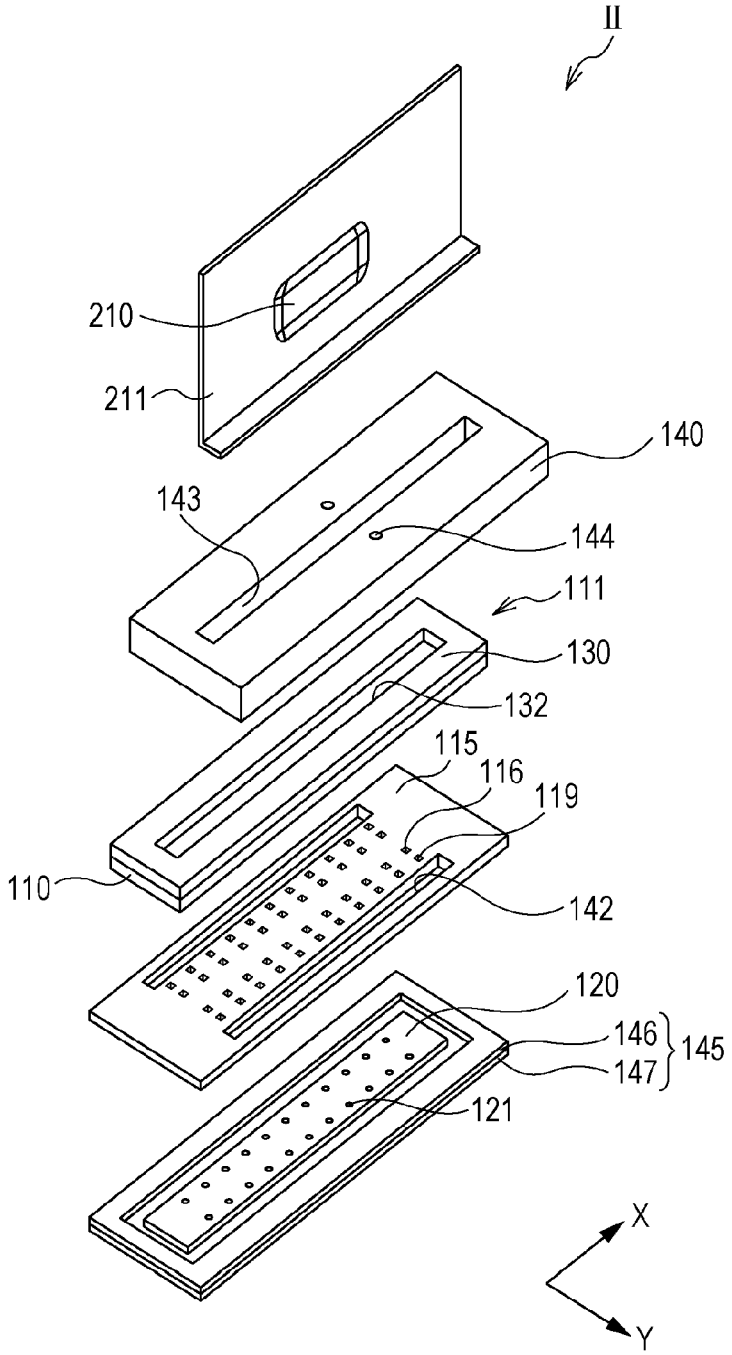
FIG. 9 is an exploded perspective view of an ink jet type recording head according to Embodiment 2.
Figure 10:
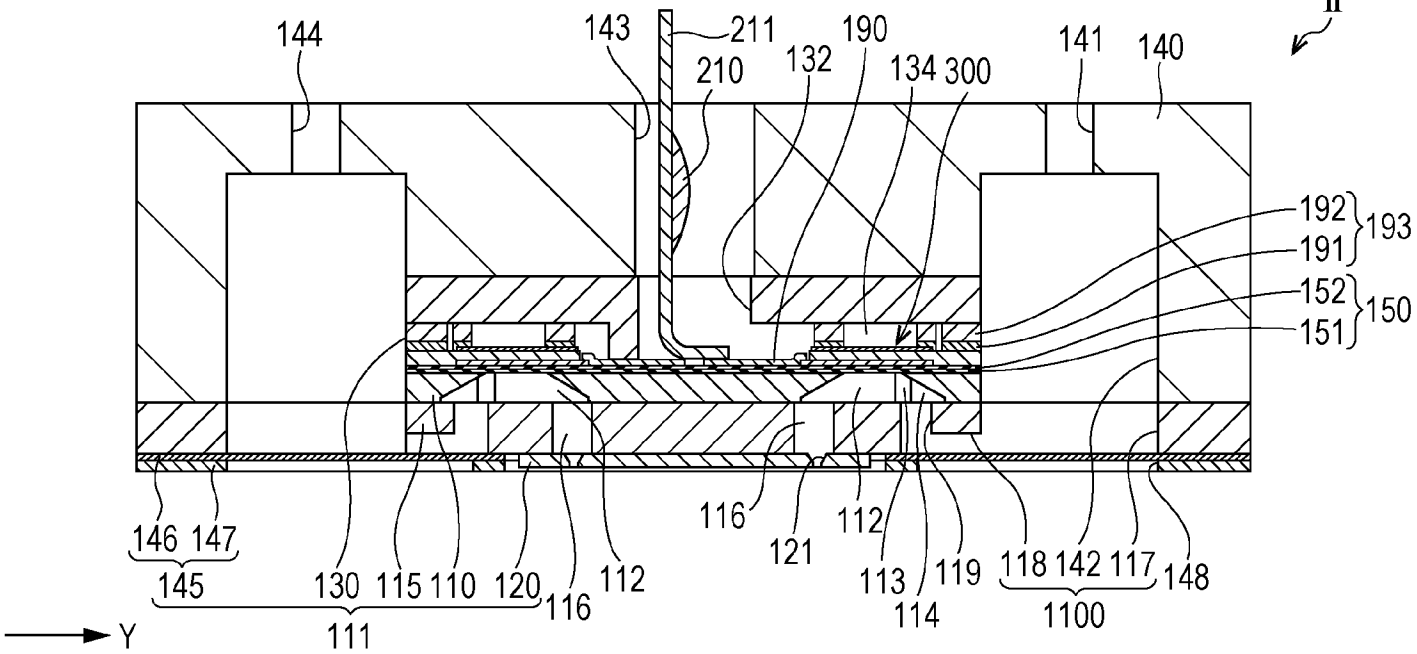
FIG. 10 is a cross-sectional view of the ink jet type recording head according to Embodiment 2.
Figure 11:
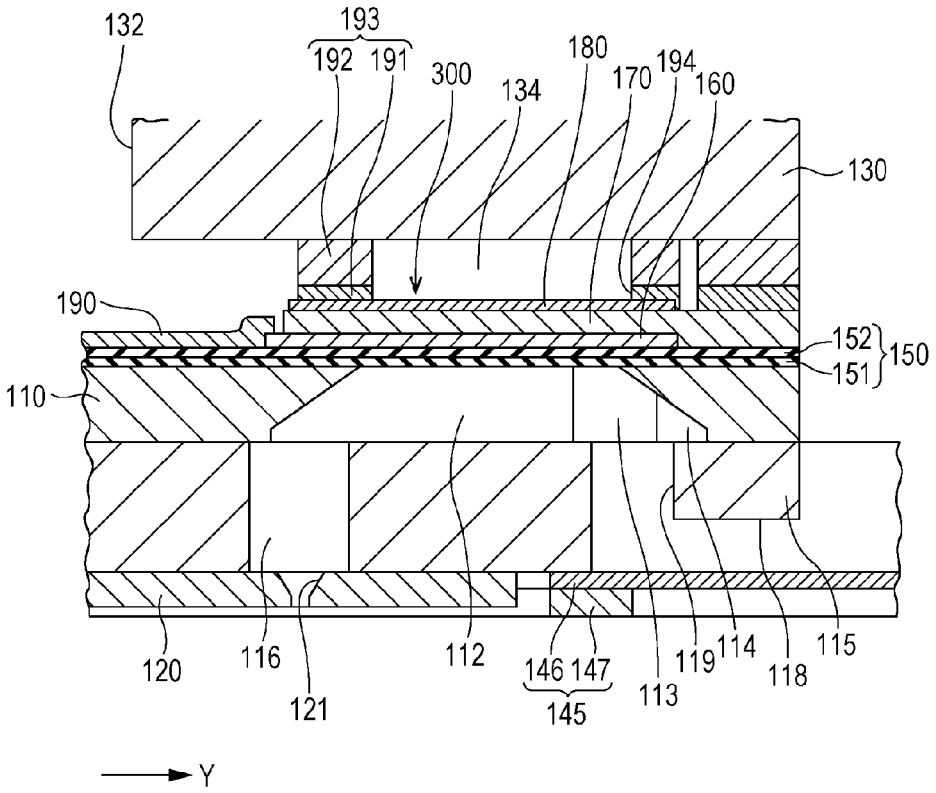
FIG. 11 is a cross-sectional view of principal portions of the ink jet type recording head according to Embodiment 2.

FIG. 9 is an exploded perspective view of an ink jet type recording head according to Embodiment 2. FIG. 10 is a cross-sectional view of the ink jet type recording head according to Embodiment 2. FIG. 11 is a cross-sectional view of principal portions of the ink jet type recording head according to Embodiment 2.

An ink jet type recording head II as an example of a liquid ejecting head according to Embodiment 2 includes a plurality of members, such as a head main body 111 and a case member 140, as illustrated in FIGS. 9 to 11. The plurality of members are joined to each other. The head main body 111 according to Embodiment 2 includes a flow-path forming substrate 110, a communication plate 115, a nozzle plate 120, a protection substrate 130, and a compliance substrate 145.

The flow-path forming substrate 110 is constituted by a silicon single crystal substrate, for example. In the flow-path forming substrate 110, pressure generation chambers 112 which are partitioned by a plurality of partition walls are aligned in a direction in which a plurality of nozzle openings 121 through which the ink is discharged are aligned. Hereinafter, this direction is referred to as an alignment direction of the pressure generation chambers 112 or the first direction X. In addition, a plurality of (two, in Embodiment 2) rows in which the pressure generation chambers 112 are aligned in the first direction X are formed in the flow-path forming substrate 110. Hereinafter, an alignment direction of a plurality of rows in which the pressure generation chambers 112 are formed along the first direction X is referred to as the second direction Y.

A feeding path 113 and a communication path 114 are formed in the flow-path forming substrate 110. The feeding path 113 communicates with one end side (a side opposite a side communicating with the nozzle opening 121) of the pressure generation chamber 112 in the second direction. The communication path 114 communicates with a side of the feeding path 113, which is a side opposite a side facing the pressure generation chambers 112.

In other words, the pressure generation chamber 112, the feeding path 113, and the communication path 114 which are partitioned by partition walls and aligned in the first direction X are formed, as an individual flow path communicating with each nozzle opening 121, in the flow-path forming substrate 110 of Embodiment 2.

In addition, a diaphragm 150 is provided on one surface of the flow-path forming substrate 110, and the flow path, such as the pressure generation chamber 112, is sealed by the diaphragm 150.

The communication plate 115 is joined to the other surface (a surface opposite to the diaphragm 150) of the flow-path forming substrate 110. Furthermore, the nozzle plate 120 on which a plurality of the nozzle openings 121 communicating with the pressure generation chambers 112 are bored is joined to the communication plate 115 by an adhesive agent.

A nozzle communication path 116 which connects the pressure generation chamber 112 and the nozzle opening 121 are formed in the communication plate 115. A size of the communication plate 115 is greater than the flow-path forming substrate 110, and a size of the nozzle plate 120 is smaller than the flow-path forming substrate 110. As described above, the nozzle plate 120 has a relatively small size, and thus it is possible to achieve a reduction in costs. In the nozzle plate 120 of Embodiment 2, a surface on which the nozzle openings 121 are formed and from which ink droplets are discharged is referred to as a liquid ejecting surface.

A first manifold portion 117 and a second manifold portion 118 which constitute a part of the manifold 100 is formed in the communication plate 115.

The first manifold portion 117 passes through the communication plate 115 in a thickness direction (a laminating direction of the communication plate 115 with respect to the flow-path forming substrate 110).

The second manifold portion 118 does not pass through the communication plate 115 in the thickness direction and is opened to the nozzle plate 120 side of the communication plate 115.

In the communication plate 115, a feeding communication path 119 which communicates with one end of the pressure generation chamber 112 in the second direction Y is formed individually for each pressure generation chamber 112. The feeding communication path 119 allows the second manifold portion 118 to communicate with the communication path 114.

The nozzle openings 121 which respectively communicate with pressure generation chambers 112 through the nozzle communication paths 116 are formed on the nozzle plate 120. In other words, a plurality (two, in Embodiment 2) of rows in which the nozzle openings 121 are aligned in first direction X are formed in the second direction Y.

Examples of materials forming the nozzle plate 120 include a metal, such as stainless steel (SUS), and a silicon single crystal substrate. When the nozzle plate 120 is constituted by a silicon single crystal substrate, a linear expansion coefficient of the nozzle plate 120 is matched with that of the communication plate 115. Thus, it is possible to prevent the substrate from being bent due to heating or cooling.

The diaphragm 150 is formed on a surface side of the flow-path forming substrate 110, which is opposite a surface facing the communication plate 115. The diaphragm 150 according to Embodiment 2 is constituted by an elastic film 151 formed on the flow-path forming substrate 110 and an insulator film 152 formed on the elastic film 151. Furthermore, the pressure generation chamber 112 is formed in such a manner that one surface of the flow-path forming substrate 110 is subjected to anisotropic etching, and a diaphragm (the elastic film 151) is provided on the other surface side of the pressure generation chamber 112.

The piezoelectric element 300 which is constituted by a first electrode 160, a piezoelectric layer 170, and a second electrode 180 is provided on the diaphragm 150, as a pressure generation unit of Embodiment 2. In this case, the piezoelectric element 300 means the portion including the first electrode 160, the piezoelectric layer 170, and the second electrode 180. Generally, any one of electrodes of the piezoelectric element 300 is set to be a common electrode, and the other electrode and the piezoelectric layer 170 is formed, in a patterning manner, for each pressure generation chamber 112. In this case, a portion which is constituted by the any one of the electrodes and the piezoelectric layer 170, which are subjected to patterning, and which is piezoelectrically distorted when voltage is applied to both electrodes is referred to as a piezoelectric active portion.

In Embodiment 2, the first electrode 160 is set to be an individual electrode of the piezoelectric element 300 and the second electrode 180 is set to be the common electrode of the piezoelectric element 300. However, there is no problem even in a case where the common electrode and the individual electrodes are switched to each other for a driving circuit configuration or a wiring configuration. In the example described above, the diaphragm 150 is constituted by the elastic film 151 and the insulator film 152. However, needless to say, the configuration is not limited thereto. For example, any one of the elastic film 151 and the insulator film 152 may be provided as the diaphragm 150. Only the first electrode 160 may be operated as a diaphragm, while the elastic film 151 and the insulator film 152 are not provided as the diaphragm 150. Further, the piezoelectric element 300 itself may practically function as a diaphragm. However, in a case where the first electrode 160 is directly provided on the flow-path forming substrate 110, it is necessary to protect the first electrode 160 by an insulating film such that the first electrode 160 and the ink are not electrically conducted.

Materials forming the first electrode 160, the piezoelectric layer 170 and the second electrode 180 are the same as those in Embodiment 1. Thus, the description thereof will not be repeated.

One end of an individual lead electrode 190 is connected to each first electrode 160. A wiring circuit board 211, such as COF, in which a driving circuit 210 is provided, is connected to the other end of the individual lead electrode 190.

Meanwhile, a first common lead electrode 191 is connected to the second electrode 180 as a common electrode. The first common lead electrode 191 according to Embodiment 2 has the substantially same shape as the second electrode 180. A center portion of the first common lead electrode 191 is removed to form an opening portion 194, and thus the first common lead electrode 191 is formed in a frame shape. The piezoelectric active portion of the piezoelectric element 300 is exposed through the opening portion 194 of the first common lead electrode 191 and this prevents the displacement of the piezoelectric active portion from being obstructed. Although not illustrated in the drawings, a part of the first common lead electrode 191 extends and is connected to the wiring circuit board 211.

Materials forming the individual lead electrode 190 and the first common lead electrode 191 are not particularly limited and include highly-conductive metals, such as gold, platinum, aluminum, and copper.

The protection substrate 130 having the substantially same size as the flow-path forming substrate 110 is fixed to a surface of the flow-path forming substrate 110, which is located on the piezoelectric element 300 side. The flow-path forming substrate 110 side of the protection substrate 130 is formed in a substantially flat shape. A second common lead electrode 192 having the same shape as the first common lead electrode 191 is provided on the protection substrate 130. Materials forming the second common lead electrode 192 and the first common lead electrode 191 are the same kind. The second common lead electrode 192 is, without using an adhesive agent, directly joined to the first common lead electrode 191. Hereinafter, the first common lead electrode 191 and the second common lead electrode 192 joined to each other are collectively referred to as a common lead electrode 193.

The first common lead electrode 191 is joined to the second common lead electrode 192, as described above, and thus a sealed space 134 is formed. In other words, the sealed space 134 is formed by the flow-path forming substrate 110 (the piezoelectric element 300), the protection substrate 130, and the common lead electrode 193.

The materials forming the first common lead electrode 191 and the second common lead electrode 192 are the same kind, and thus it is possible to apply a thermocompression bonding method in which the electrodes are directly joined without using an adhesive agent. The first common lead electrode 191 is directly joined to the second common lead electrode 192, as described above, and thus a sealability of the sealed space 134 can be improved, compared to the case using an adhesive agent. In the case using an adhesive agent, there is a possibility that moisture may be permeate through the adhesive agent. However, in the case applying a direct joining method, such a possibility is further reduced.

As described above, the sealability of the sealed space 134 is further ensured. Thus, it is possible to adjust the initial bent state of the diaphragm 150 in such a manner that the inner portion of the sealed space 134 is set to be under the positive pressure or the negative pressure. In addition, it is possible to maintain the positive or negative pressure adjustment state for a long period of time.

Furthermore, electrical resistance of the common lead electrode 193 can be reduced by increasing a thickness of the electrode without changing a width (in the first direction X and in the second direction Y) thereof. As a result, it is possible to provide an ink jet type recording head II of which a size in the width direction is reduced and of which the electrical resistance is reduced.

In addition, the common lead electrode 193 constitutes a side surface of the sealed space 134, and thus the protection substrate 130 can have a flat shape. In other words, it is not necessary to form a concave portion, which corresponds to the piezoelectric element holding portion 31 of Embodiment 1, in the protection substrate 130. Accordingly, a process required to form a concave portion in the protection substrate 130 is not necessary, and thus it is possible to reduce costs.

A through-hole 132 is formed in the protection substrate 130. The other end of the individual lead electrode 190 extends to be exposed inside the through-hole 132. The individual lead electrode 190 and the wiring circuit board 211 are electrically connected in the through-hole 132.

The case member 140 is fixed to the head main body 111 configured as above. The case member 140 and the head main body 111 define the manifold 100 which communicates with a plurality of the pressure generation chambers 112. The case member 140 has the substantially same shape as the communication plate 115, when seen in a plan view. The case member 140 is fixed to the protection substrate 130 by an adhesive agent and is also fixed to the communication plate 115 by an adhesive agent. Specifically, a concave portion 141 of which a depth is sufficient to accommodate the flow-path forming substrate 110 and the protection substrate 130 therein is formed on the protection substrate 130 side of the case member 140. The flow-path forming substrate 110 and the like are accommodated in the concave portion 141, and an opening surface of the concave portion 141, which faces the nozzle plate 120 side, is sealed by the communication plate 115.

Accordingly, a third manifold portion 142 which is formed by the case member 140 and the head main body 111 is formed on an outer periphery of the flow-path forming substrate 110. A manifold 1100 of Embodiment 2 is constituted by the first manifold portion 117, the second manifold portion 118 and the third manifold portion 142. The first manifold portion 117 and the second manifold portion 118 are formed in the communication plate 115, and the third manifold portion 142 is formed by the case member 140 and the flow-path forming substrate 110.

Materials forming the case member 140 include resin and metal. Furthermore, it is preferable that the protection substrate 130 be formed of a material of which a linear expansion coefficient is the same as that of the flow-path forming substrate 110 to which the protection substrate 130 is fixed. In Embodiment 2, a silicon single crystal substrate is applied.

The compliance substrate 145 is provided on a surface of the communication plate 115, in which the first manifold portion 117 and the second manifold portion 118 are opened. The compliance substrate 145 seals openings of the first manifold portion 117 and the second manifold portion 118.

The compliance substrate 145 of Embodiment 2 includes a sealing film 146 and a fixing substrate 147. The sealing film 146 is constituted by a flexible thin film (a thin film which is formed of polyphenylene sulfide (PPS) or stainless steel (SUS) and of which a thickness is equal to or less than 20 μm, for example). The fixing substrate 147 is formed of a hard material, for example, a metallic material such as stainless steel (SUS). A part of the fixing substrate 147, which is opposite the manifold 1100, is completely removed in the thickness direction to form an opening portion 148. Thus, one surface of the manifold 1100 forms a compliance portion which is a bendable portion sealed by only the sealing film 146 having flexibility.

An introduction path 144 which communicates with the manifold 1100 and through which the ink is fed to each manifold 1100 is formed in the case member 140. In addition, a connection port 143 which communicates with the through-hole 132 of the protection substrate 130 and in which the wiring circuit board 211 is inserted is formed in the case member 140.

In the ink jet type recording head II configured as above, the ink is ejected by following a procedure described below. First, the ink is fed from an ink storage unit, such as a cartridge, through the introduction path 144. Thus, the flow path which runs from the manifold 1100 to the nozzle opening 121 is filled with the ink. Then, voltage is applied, based on a signal transmitted from the driving circuit 210, to each piezoelectric element 300 corresponding to each pressure generation chamber 112. Therefore, the elastic film 151 and the insulator film 152 are flexibly deformed along with the piezoelectric element 300. As a result, a pressure in the pressure generation chamber 112 increases, and thus ink droplets are ejected through the specified nozzle openings 121.

Other Embodiments

Hereinbefore, embodiments of the invention are described. However, a basic configuration of the invention is not limited thereto.

Figure 12:
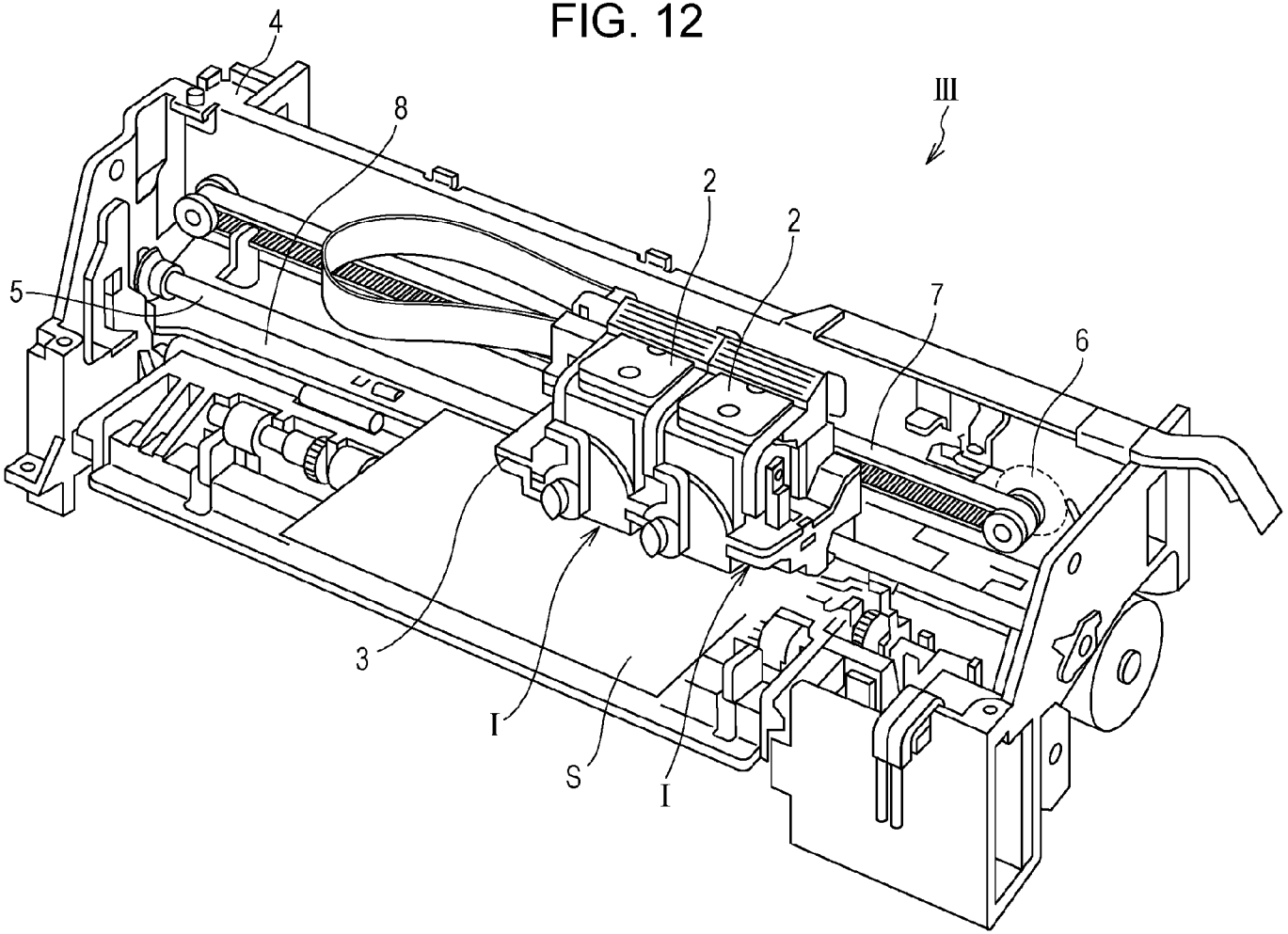
FIG. 12 is a schematic view of an ink jet type recording apparatus.

The ink jet type recording head I (or the ink jet type recording head II) is mounted on, for example, an ink jet type recording apparatus III, as illustrated in FIG. 12. The ink jet type recording apparatus III includes an apparatus main body 4. A carriage shaft 5 is installed in the apparatus main body 4. A carriage 3 is axial-movably installed on the carriage shaft 5. A cartridge 2 which constitutes an ink feeding unit is detachably mounted in the carriage 3, and the ink jet type recording head I is mounted in the carriage 3.

A driving force from a driving motor 6 is transmitted to the carriage 3, via a plurality of gears (not illustrated) and a timing belt 7, and thus the carriage 3 on which the ink jet type recording head I is mounted moves along the carriage shaft 5. Meanwhile, a platen 8 is installed, along the carriage shaft 5, in the apparatus main body 4. A recording sheet S which is a recording medium, such as a paper sheet, and which is fed by a paper feeding roller or the like (not illustrated) is wound around the platen 8 and transported.

In the ink jet type recording head I according to the embodiments of the invention, the diaphragm 50 is efficiently deformed to discharge the ink, as described above. Thus, the ink jet type recording head I has highly-efficient ink-discharging properties. Thus, it is possible to realize the ink jet type recording apparatus III which performs printing with high efficiency.

In the example described above, a recording apparatus in which the ink jet type recording head I is mounted on the carriage 3 and the carriage 3 moves in a scanning direction is exemplified as the ink jet type recording apparatus III. However, the configuration is not particularly limited thereto. The ink-jet type recording apparatus III may be a so-called line type recording apparatus in which printing is performed in such a manner that an ink-jet type recording head I is fixed and the recording sheet S, such as a paper sheet, is transported in a vertical scanning direction.

In the embodiments described above, the ink-jet type recording head is exemplified as a liquid ejecting head. However, the invention is intended to be applied to general types of a liquid ejecting head. Other examples of the liquid ejecting head include various types of recording heads which are applied to image recording apparatuses, such as a printer, a coloring material ejecting head used to manufacture a color filter for a liquid crystal display or the like, an electrode material ejecting head used to form an electrode for an organic EL display, a field emission display (FED) or the like, a bio-organic material ejecting head used to manufacture a biochip, or the like.

In addition, the invention can be applied not only to the liquid ejecting head (an ink jet type recording head) described above but also to an actuator device mounted to various kinds of devices. An actuator device of the invention can be applied to, for example, various types of sensors.

What is claimed is:

1. A liquid ejecting head comprising:

a flow-path forming substrate including a plurality of pressure generation chambers that communicate with nozzle openings through which liquid is ejected;

an actuator device that is provided on the flow-path forming substrate and applies a pressure to the pressure generation chambers via a diaphragm; and a joining substrate that is joined to the flow-path forming substrate and forms a sealed space for sealing the actuator device, wherein a pressure in the sealed space is adjusted such that the diaphragm is drawn up to the actuator side or is pressed down to the pressure generation chamber side, wherein the diaphragm is bent toward the actuator device side when the actuator device is not operated, wherein the diaphragm is bent toward the pressure generation chamber side when the actuator device is operated, and wherein a pressure in the sealed space is adjusted to be lower than the atmospheric pressure such that, when a joint surface between the flow-path forming substrate and the diaphragm is set to a reference plane, a position of the diaphragm when the actuator device is not operated is set to a first displacement, and a bent position of the diaphragm closest to the pressure generation chamber side when the actuator device is operated is set to a second displacement, the first displacement is equal to or greater than the second displacement.

2. The liquid ejecting head according to claim 1, wherein the diaphragm is bent toward the pressure generation chamber side when the actuator device is not operated, wherein the diaphragm is bent toward the pressure generation chamber side when the actuator device is operated, and wherein a pressure in the sealed space is adjusted to be lower than the atmospheric pressure.

3. The liquid ejecting head according to claim 1, wherein the diaphragm is bent toward the actuator device side when the actuator device is not operated, wherein the diaphragm is bent toward the actuator device side when the actuator device is operated, and wherein a pressure in the sealed space is adjusted to be higher than the atmospheric pressure.

4. A liquid ejecting head comprising:

a flow-path forming substrate including a plurality of pressure generation chambers that communicate with nozzle openings through which liquid is ejected;

an actuator device that is provided on the flow-path forming substrate and applies a pressure to the pressure generation chambers via a diaphragm; and a joining substrate that is joined to the flow-path forming substrate and forms a sealed space for sealing the actuator device, wherein a pressure in the sealed space is adjusted such that the diaphragm is drawn up to the actuator side or is pressed down to the pressure generation chamber side, wherein the diaphragm is bent toward the actuator device side when the actuator device is not operated, wherein the diaphragm is bent toward the pressure generation chamber side when the actuator device is operated, and wherein a pressure in the sealed space is adjusted to be higher than the atmospheric pressure such that, when a joint surface between the flow-path forming substrate and the diaphragm is set to a reference plane, a position of the diaphragm when the actuator device is not operated is set to a first displacement, and a bent position of the diaphragm closest to the pressure generation chamber side when the actuator device is operated is set to a second displacement, the second displacement is equal to or greater than the first displacement.

5. A liquid ejecting apparatus comprising:

the liquid ejecting head according to claim 1.

6. A liquid ejecting apparatus comprising:

the liquid ejecting head according to claim 2.

7. A liquid ejecting apparatus comprising:

the liquid ejecting head according to claim 3.

8. A liquid ejecting apparatus comprising:

the liquid ejecting head according to claim 4.

* * * * *